US005505069A

United States Patent [19]

Break et al.

[11] Patent Number: 5,505,069

[45] Date of Patent: Apr. 9, 1996

[54] SHEET BENDING BRAKE

[75] Inventors: Douglas G. Break, Livonia; Arthur B. Chubb, Romulus; Douglas J. Chubb, Dearborn; James E. Suyak, Lincoln Park, all of Mich.

[73] Assignee: Tapco International Corporation, Plymouth, Mich.

[21] Appl. No.: 254,177

[22] Filed: Jun. 6, 1994

[51] Int. Cl.[6] ..... B21D 5/04

[52] U.S. Cl. ..... 72/319

[58] Field of Search ..... 72/319–323, 316

[56] References Cited

U.S. PATENT DOCUMENTS

| | | | |
|---|---|---|---|
| 3,161,223 | 12/1964 | Marsh | 72/297 |
| 3,481,174 | 12/1969 | Barnack | 72/319 |
| 3,482,427 | 12/1969 | Barnack | 72/319 |
| 3,559,444 | 2/1971 | Blazey | 72/296 |
| 3,817,075 | 6/1974 | Marsh | 72/319 |
| 3,872,755 | 3/1975 | Marsh | 83/471.3 |
| 4,240,279 | 12/1980 | Rhoades | 72/319 |
| 4,321,817 | 3/1982 | Barnack | 72/319 |
| 4,372,142 | 2/1983 | Rhoades | 72/319 |
| 4,489,583 | 12/1984 | Rhoades | 72/319 |
| 4,493,200 | 1/1985 | Rhoades | 72/319 |
| 4,512,174 | 4/1985 | Rhoades | 72/319 |
| 4,557,132 | 12/1985 | Break | 72/319 |
| 4,651,553 | 3/1987 | Rhoades | 72/319 |
| 4,918,966 | 4/1990 | Raccioppi | 72/319 |

FOREIGN PATENT DOCUMENTS

| | | | |
|---|---|---|---|
| 1097242 | 7/1955 | France | 72/320 |
| 303138 | 1/1918 | Germany | 72/321 |
| 770085 | 3/1957 | United Kingdom | 72/320 |

*Primary Examiner*—Daniel C. Crane

*Attorney, Agent, or Firm*—Barnes, Kisselle, Raisch, Choate, Whittemore & Hulbert

[57] ABSTRACT

A sheet bending brake comprises a first longitudinally extending member having a clamping surface and a second member for bending a workpiece clamped on said clamping surface extending longitudinally with respect to said first member. Each of the first and second members has substantially the entire length of the longitudinal edges thereof formed with longitudinally spaced intermeshing integral projections. The projections on the second member have a plurality of aligned openings. A hinge pin extends through the openings of the second member. The second member includes an integral upper tubular portion and integral upper portion comprising an outer wall that extends upwardly and outwardly from a vertical wall of the lower portion; an integral horizontal upper wall; an integral rear wall that extends downwardly and inwardly to the front edge of the upper flange.

6 Claims, 8 Drawing Sheets

SHEET BENDING BRAKE

This invention relates to sheet bending brakes.

BACKGROUND AND SUMMARY OF THE INVENTION

In recent years, various structures have been provided to form a portable sheet bending brake for bending metal or plastic sheets such as are used in siding on homes and buildings. Typical patents comprise U.S. Pat. Nos. 3,161,223, 3,481,173, 3,482,427, 3,559,444, 3,817,075, 3,872,755 and 4,321,817.

Such brakes comprise a fixed member on which the sheet is clamped and a movable bending member for bending the sheet. A major problem with respect to such sheet bending brakes is the tendency of the bending member to move relative to the portion of the sheet being bent and thereby mar the surface of the sheet.

In U.S. Pat. No. 3,161,223, the tendency to mar the surface of the sheet material was minimized by having the intermeshing integral projections between the fixed member and bending member which extend longitudinally and define the hinge that connects the bending member with the fixed member having the clamping surface, positioned so that all portions of the projections do not extend above the plane of the surface of the members when the surfaces are substantially aligned.

U.S. Pat. Nos. 3,481,174 and 3,482,427 were directed to an arrangement which included a floatable compensator on the bending member which engages the sheet material and as the bending member is swung to bend the sheet pivots so that the contact with the sheet material is maintained.

In U.S. Pat. No. 4,537,132 there is disclosed and claimed a sheet bending brake that incorporates a novel construction for minimizing the marring of the surface of the sheet material during bending; which functions without the need for added parts; which can be manufactured at low cost; and which can be adapted to sheet material of various thickness; and which can be utilized in a novel fashion to provide a complete 180° bend to the sheet material.

As described in the aforesaid patent, each of the fixed and movable bending members have substantially the entire length of the longitudinal edges thereof formed with longitudinally spaced intermeshing integral projections. The projections on the bending member having a plurality of aligned openings and the projections on the fixed member have a plurality of aligned openings comprising slots extending axially with respect to the longitudinal axis of said member. A hinge pin extends through the openings of said bending member and the slots of the fixed member. The slots have a configuration such that as the bending member is moved relative to the fixed member to bend a workpiece, the hinge pin is guided along said slots such that the contacting portion of the bending member remains substantially in the same position relative to the workpiece.

Among the objectives of the present invention are to provide a sheet bending brake which has an improved clamping surface; which provides greater depth for receipt of workpieces to be bent; and which is stronger in construction.

DESCRIPTION OF THE PREFERRED EMBODIMENTS

Figure 1:
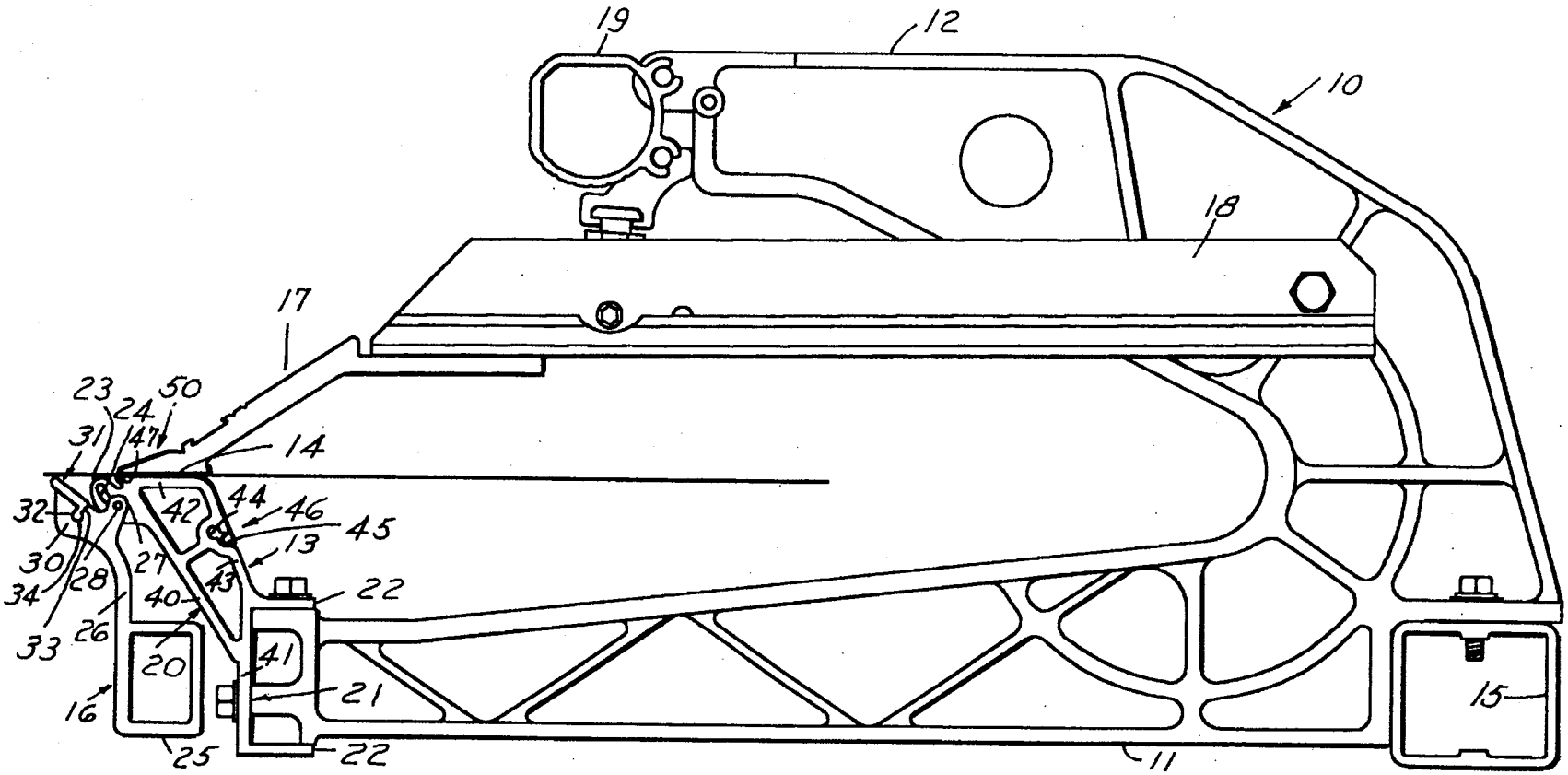
FIG. 1 is an end elevational view of a sheet bending brake embodying the invention.
Figure 2:
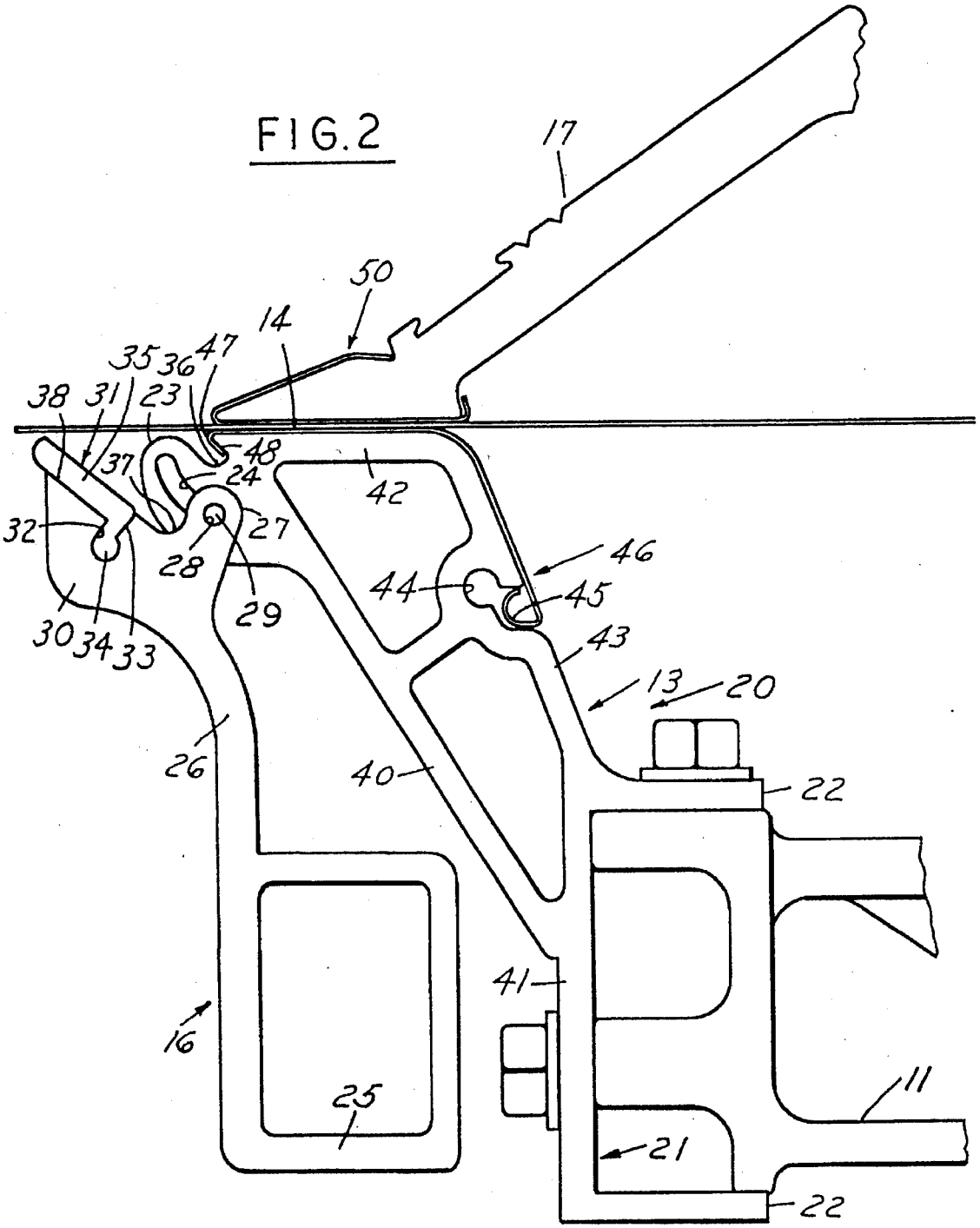
FIG. 2 is an elevational view of a portion of the brake shown in FIG. 1 on an enlarged scale.
Figure 3:
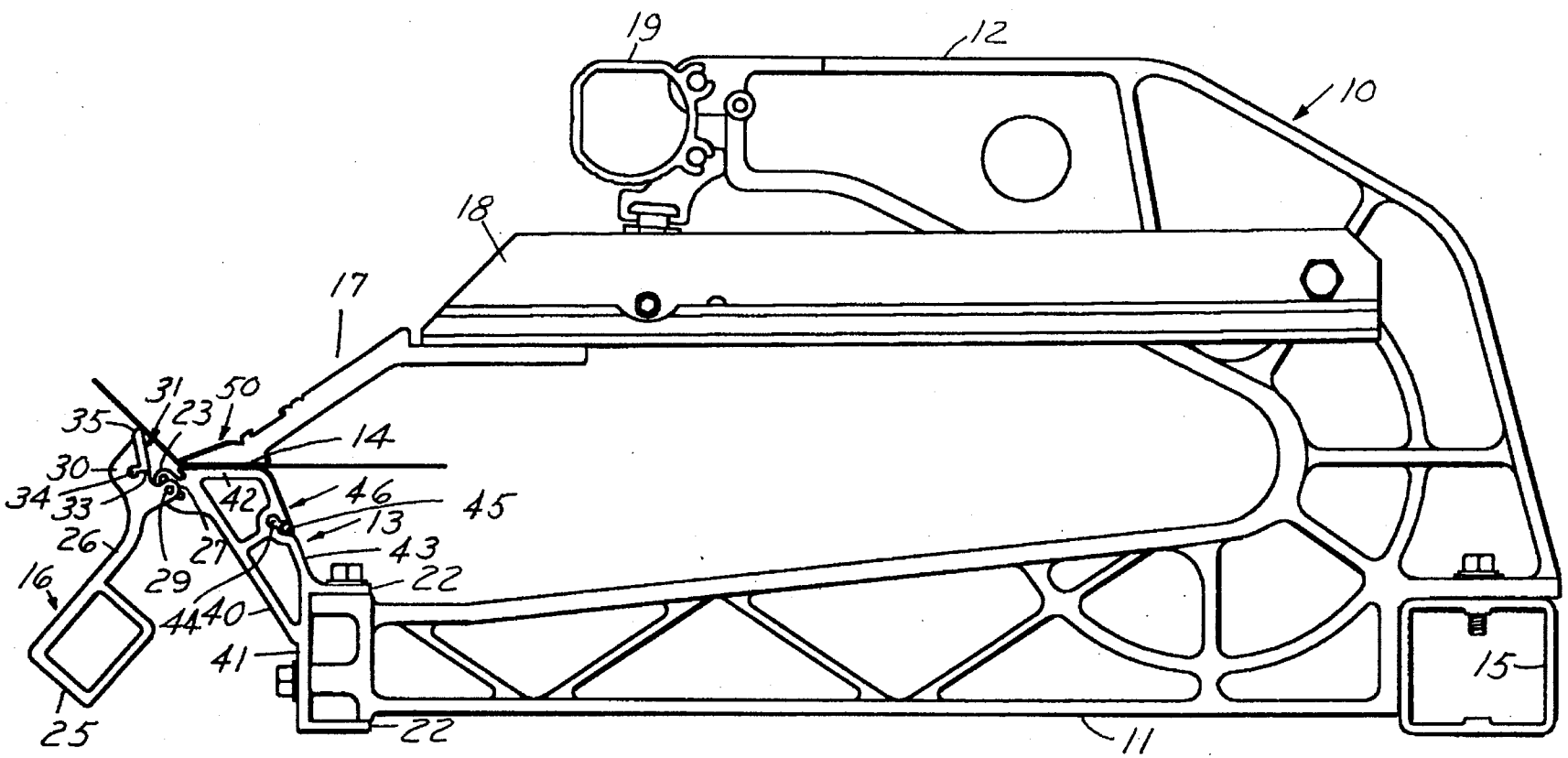
FIGS. 3 and 3 are similar to FIGS. 1 and 2 but show the the brake in different operating positions.
Figure 4:
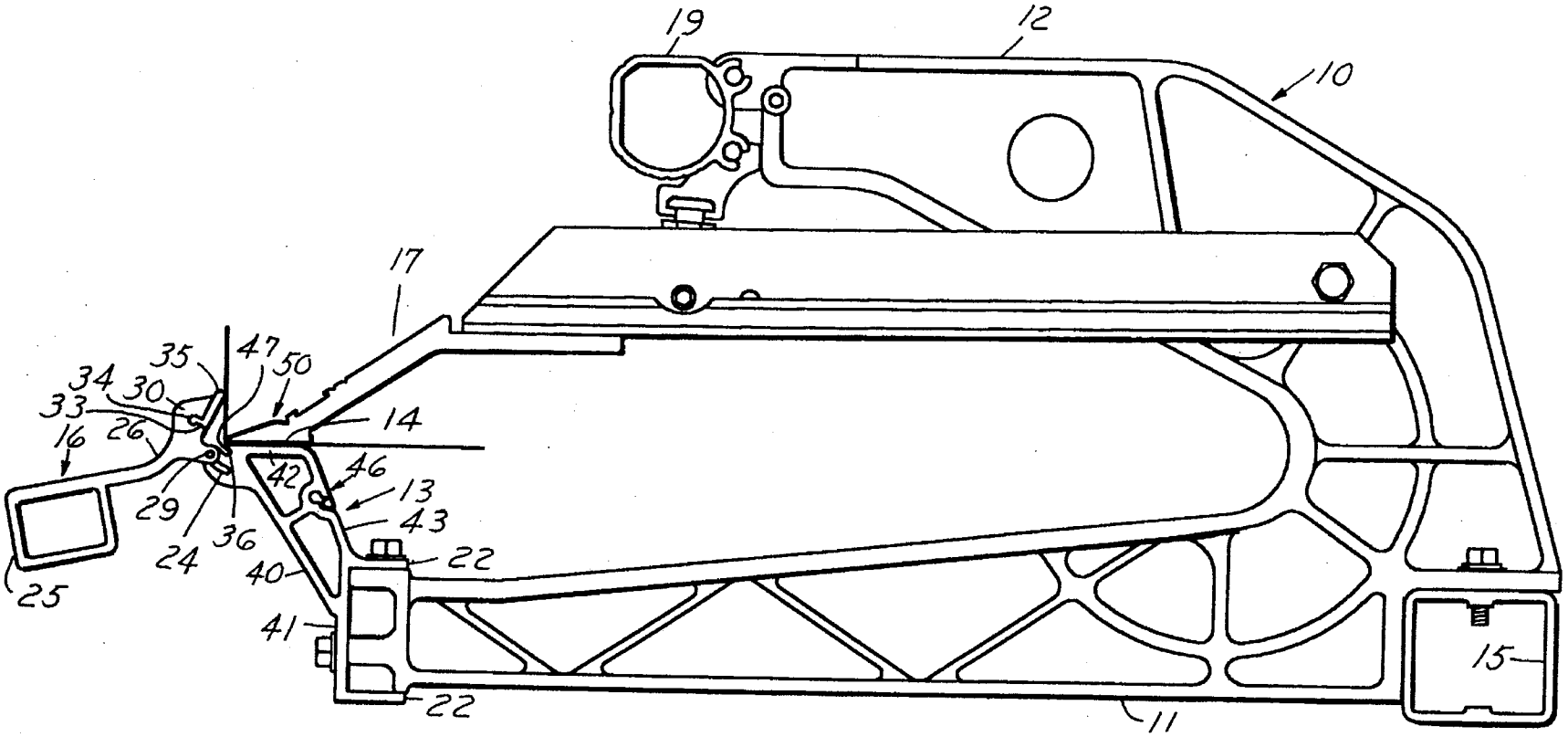
Figure 5:
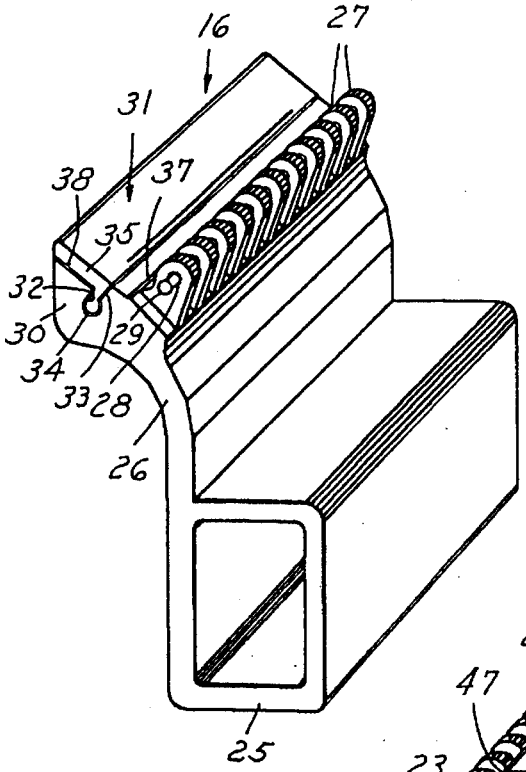
FIG. 5 is a fragmentary perspective view of a portion of the bending member.

Referring to FIGS. 1 and 2, the sheet bending brake embodying the invention comprises longitudinally spaced C-shaped frame members 10. Each frame member 10 includes a lower arm 11 and an upper arm 12 which overlies the lower arm 11 in spaced relation thereto. Legs may be provided as needed to support the brake above the floor or working area.

A first extruded fixed member 13 is fixed on the ends of the free lower arms 11 and defines a clamping surface 14. Longitudinally spaced base rails 15 are fixed to the rear end of the lower arms 11. A second extruded bending member 16 is hinged to the first member 13, as presently described, to provide a means for bending the sheet material.

Clamping member 17 extends longitudinally in overlying relationship to the clamping surface 14 of the first member 13. Means are provided for moving the anvil member toward and away from the clamping surface to clamp a workpiece on the clamping surface. The means for clamping the workpiece may comprise any of the structures set forth in the aforementioned United States Patents, incorporated herein by reference, but as herein shown comprise channel shaped pivot bars 18 pivoted on each frame member 10 with the clamping member 17 fixed thereto and handle member 19 pivoted to the upper arm 12 of each C-frame member 10 and to the pivot bars 18 by a plurality of extensible links 19 pivoted at the upper edge to the handle member 19 and at the lower end to the pivot bars 18. The extensible links may be of the type shown in U.S. Pat. No. 4,776,757, incorporated herein by reference, or copending U.S. patent application Ser. No. 08/111,978 filed Aug. 25, 1993, incorporated herein by reference. The first member 13 having the clamping surface 14 is formed as an aluminum extrusion and includes an upper tubular portion 20 and a lower portion 21 including spaced flanges 22 engaging the free ends of lower arms 11. A plurality of longitudinally spaced projections 23 are provided at the juncture of the portion 20 which defines the clamping surface 14. Each projection 23 has a slot 24 formed therein and the slots 24 of the various projections 23 are in longitudinal alignment. Each slot 24 has its lower ends spaced from the clamping surface A and extends outwardly and upwardly so that its upper end is generally near the plane of the clamping surface. Each slot 24 is preferably arcuate and has a center spaced from the clamping surface and preferably extends for substantially 90°.

The bending member 16 is also in the form of an extrusion including a tubular portion 25 and a longitudinally extending leg 26 with a plurality of longitudinally spaced projections 27 having openings 28 therein. The projections 27 of the bending member 16 mesh with the projections 23 of the fixed member 13 and a pin 29 extends through the openings 28 and slots 24 to hinge the bending member 16 to the fixed member 13. The bending member 16 further includes a portion 30 that extends upwardly and outwardly when the bending member 16 is in position for bending and has a contacting portion defined by a longitudinally extending plastic strip 31 positioned in a recess 32. The recess is generally L-shaped and the strip 31 includes a short leg 33 having an enlarged end portion 34 for holding the strip 31 and the other leg 35 thereof extends along the recess beyond the portion to define a sheet contacting portion. Strip is preferably made of polyurethane having a durometer of 60 on the A scale.

The fixed member 13 further includes a recess 36 extending longitudinally at the juncture of the clamping surface 14 and the projections 23. Recess 36 functions as a pocket into which any burrs may fall from a knife used for scoring the workpiece. The clamping surface 14 is spaced slightly above the projections 23 in order to minimize marring of the surface of the workpiece when it is inserted and removed. The bending member 16 also includes a recess 37 extending longitudinally between the projections 27 and the contacting portion 31.

Referring to FIGS. 1–4 and 10–12, in use, a workpiece of sheet material is clamped against the clamping surface 14 and the bending member 16 is moved by swinging the handle bringing the contacting portion of the bending member 16 in engagement with the sheet material. As the bending member is swung upwardly, the hinge pin 29 on the bending member 16 moves along the slots 24 and is guided in a fashion such that the contacting portion maintains substantially the same relative position of contact thereby minimizing marring of the surface of sheet material.

Figure 6:
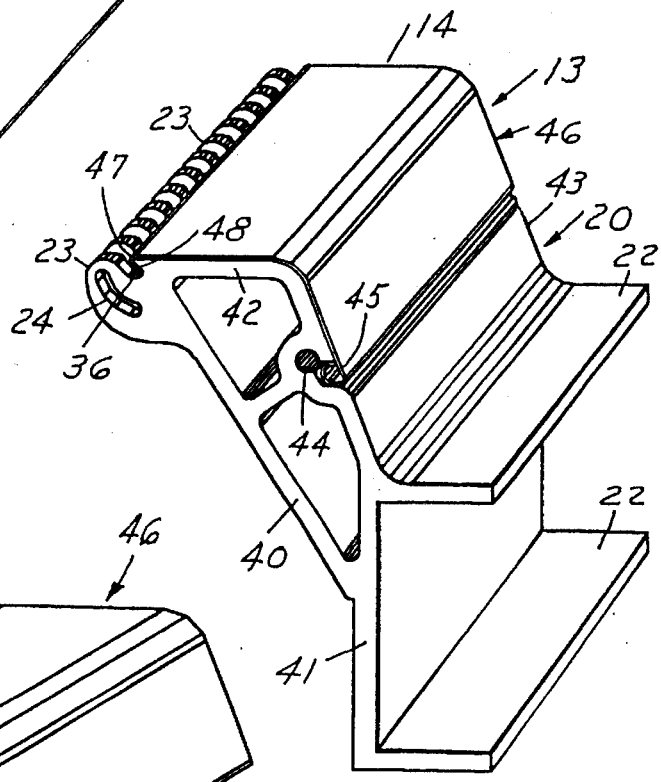
FIG. 6 is a fragmentary perspective view of a portion of the fixed member.
Figure 9:
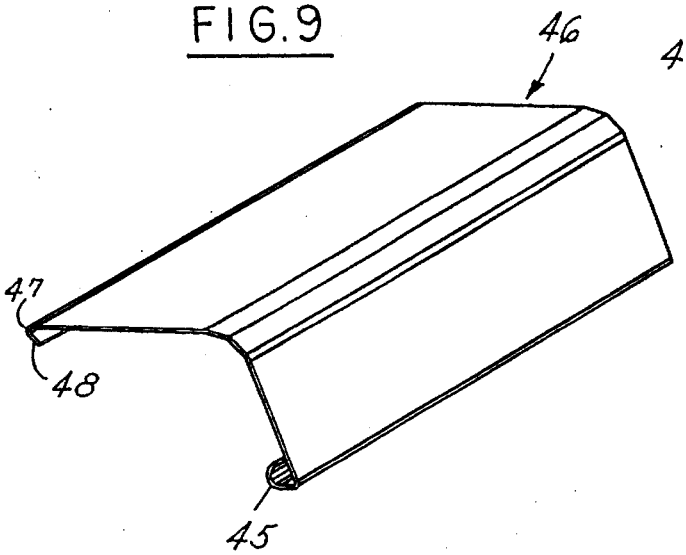
FIG. 9 is a fragmentary perspective view of a wear plate utilized on the fixed member.
Figure 7:
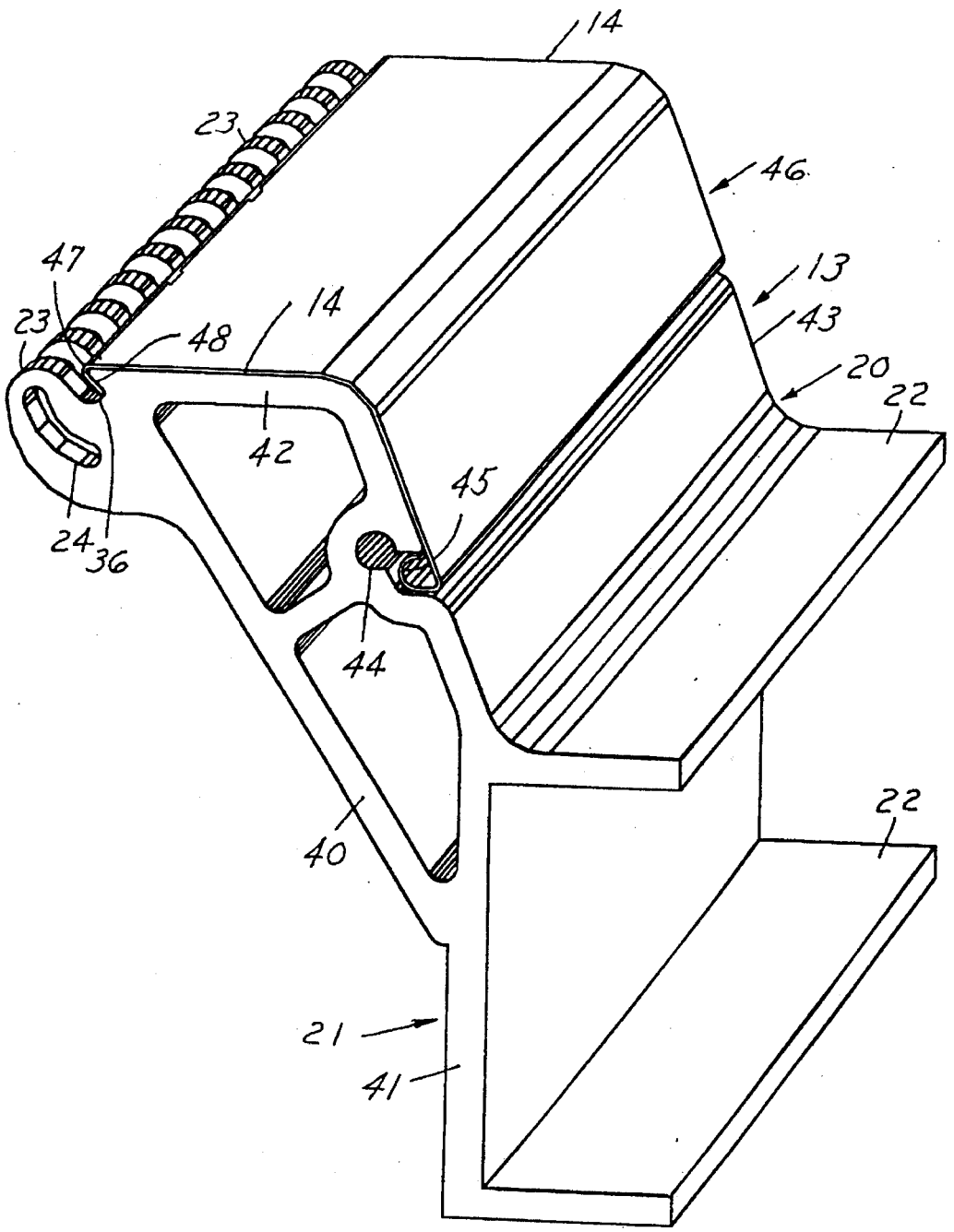
FIG. 7 is an enlarged perspective view of the fixed member shown in FIG. 6.
Figure 8:
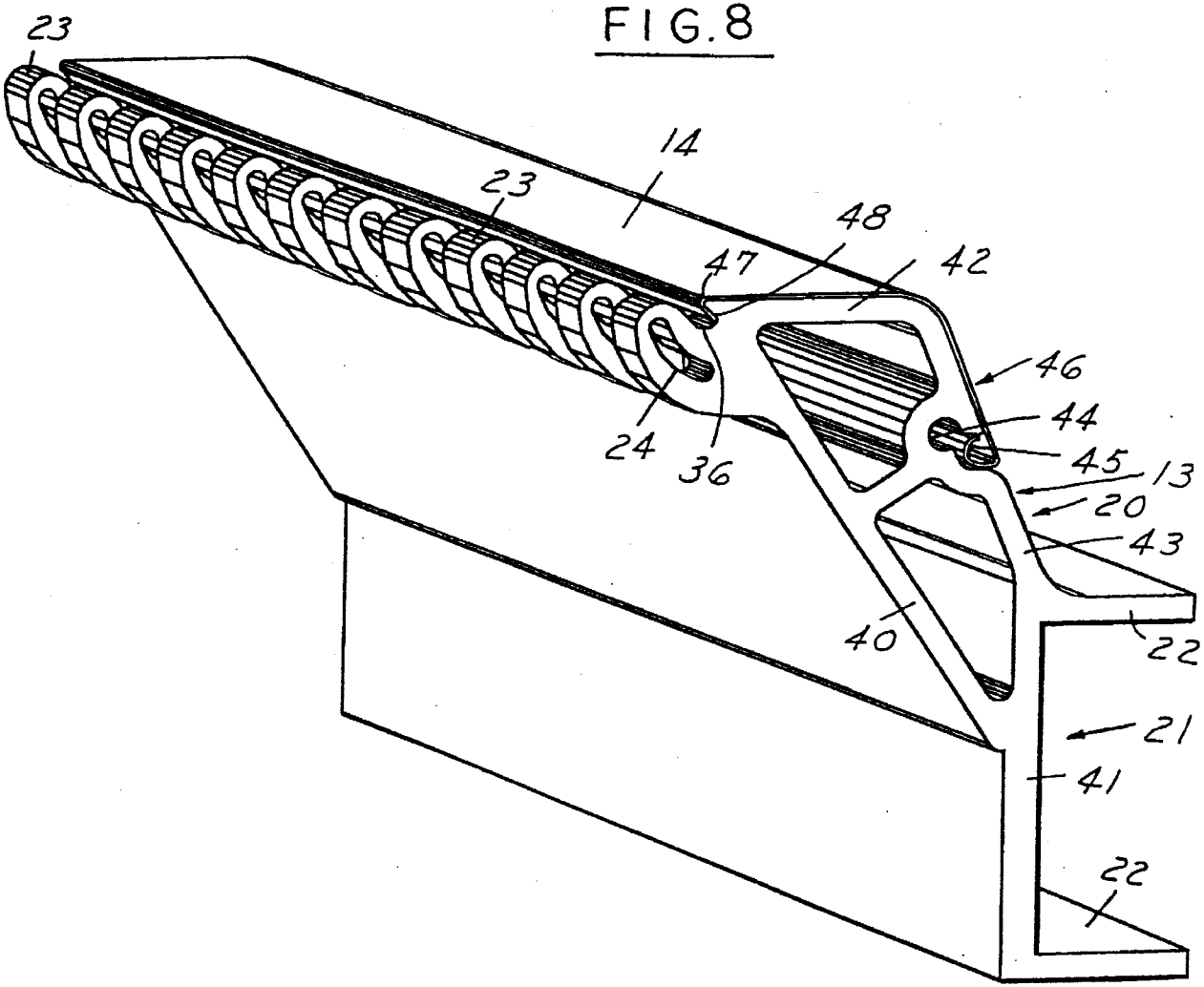
FIG. 8 is a perspective view of the fixed member taken from the left as viewed in FIG. 7.
Figure 10:
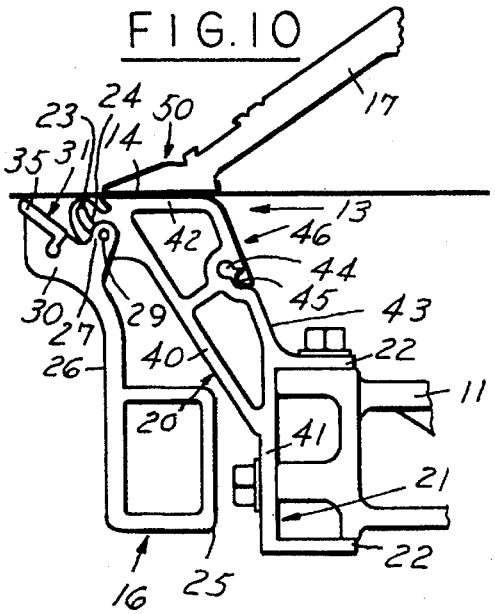
FIGS. 10, 11 and 12 are fragmentary end views showing portions of the sheet bending brake in different operative positions.
Figure 11:
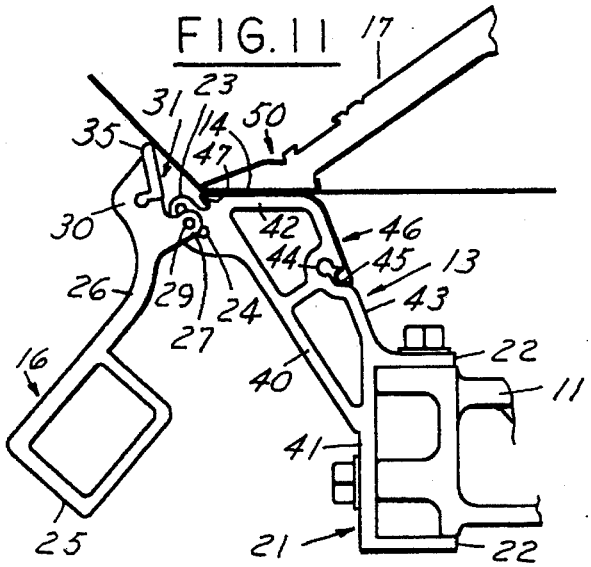
Figure 12:
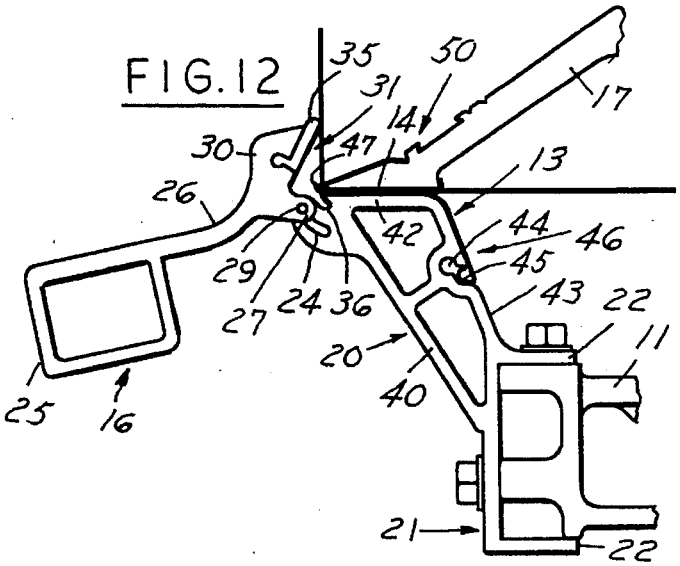

As shown in FIG. 2, the arcuate slots 24 extend generally from below the nose or bending edge of the clamping member upwardly and outwardly toward the user so that the hinge 16 moves along slots 24 as the workpiece is being bent until the hinge pin 29 reaches the upper end of the slots 24 (FIG. 6) after which the bending member 16 can be moved further to bend the workpiece into contact with the upper inclined surface of the clamping member 17.

Hemming can thereafter be achieved by unclamping the workpiece and placing the apex of the bend which has been formed on the workpiece in contact with the nose of the clamping member 16 and swinging the bending member 16 to compress and flatten the two bent portions of the workpiece against the upper surface of the clamping member 17. In bending, the bend can be interrupted at any time and begin without marring the surface of the workpiece. In addition, the workpiece can be bent with only a short portion extending beyond the nose of the clamping member 17, for example, a ¼". The use of slots 24 also facilitates assembly of the hinge pin 29 and makes the member 13 easier to extrude.

The aforementioned construction is shown in U.S. Pat. No. 4,557,132 incorporated herein by reference.

In accordance with the invention, the upper tubular portion 20 of the member 13 comprises an outer wall 40 that extends upwardly and outwardly from the vertical wall 41 of the lower portion; an integral horizontal wall 42; and integral rear wall 43 that extends downwardly and inwardly to the front edge of the upper flange 22. The outer wall 40 and rear wall 43 converge downwardly with respect to one another. Rear wall 43 includes a recessed portion 44 for receiving a hook 45 on the rear edge of a stainless steel wear plate 46. The front edge 47 of plate 46 includes a hook 48 engaging recess 36. An integral web **44*a* extends from the recessed portion 44 to the rear surface of the front wall 40**.

The clamping member 17 further includes a protective metal strip of sheet metal such as stainless steel having edges received in corresponding received in corresponding recesses as shown in U.S. Pat. No. 4,651,553, incorporated herein by reference.

It has been found that the construction strengthens the bending brake and more specifically the fixed member 13 while also providing a protective bearing surface on the horizontal wall against which the workpiece is clamped. In addition, the sheet bending brake embodying the invention provides an improved clamping surface and a greater depth of throat for receiving workpieces which are to be bent.

What is claimed is:

1. A sheet bending brake comprising a first longitudinally extending member having a clamping surface, a plurality of C-shaped members having an upper arm and lower arm, said first longitudinally extending member on said lower arms of said C-shaped members, means movable toward and away from the clamping surface for holding a workpiece in position for bending, a second member for bending a workpiece clamped on said clamping surface extending longitudinally with respect to said first member, each of said first and second members having substantially the entire length of the longitudinal edges thereof formed with longitudinally spaced intermeshing integral projection, the projections on said second member having a plurality of aligned openings, the projections on said first member having a plurality of aligned openings extending axially with respect to the longitudinal axis of said member, a hinge pin extending through said openings of said second member and said slots of said first member, said second member having a fixed workpiece contacting portion spaced from the projections, said workpiece contact surface being fixed relative to said hinge pin, said first member including an integral upper tubular portion and integral lower portion, said lower portion including a vertical wall, an integral upper flange and an integral lower wall fastened to each said C-shaped member, said upper tubular portion comprising an outer wall that extends upwardly and outwardly from said vertical wall of said lower portion; and integral horizontal upper wall; an integral rear wall that extends downwardly and inwardly to a front edge of the upper flange of said lower portion, said outer wall and rear wall both extending in a non-parallel orientation relative to said vertical wall of said lower portion, and a stainless steel wear plate having a hook along each edge thereof, said upper portion including a recess portion receiving one of said hooks, said rear wall including a recessed portion for receiving the other of said hooks on a rear edge of the stainless steel wear plate, said one hook having a front edge for engaging said recess portion of said upper portion.

2. The sheet bending brake set forth in claim 1 including an integral web extending from the recessed portion to the rear surface of the front wall.

3. The sheet bending brake set forth in any one of claims 1 and 2 wherein said front and rear walls converge downwardly.

4. In a sheet bending brake comprising a first longitudinally extending member having a clamping surface, means movable toward and away from the clamping surface for holding a workpiece in position for bending, a second extruded member for bending a workpiece clamped on said clamping surface extending longitudinally with respect to said first member, each of said first and second members having substantially the entire length of the longitudinal edges thereof formed with longitudinally spaced intermeshing integral projections, the projections on said second member having a plurality of aligned openings, a hinge pin extending through said openings of said second member, the method comprising providing said first member with an integral upper tubular portion and integral lower portion, providing a vertical wall on said lower portion and an upper flange and lower flange on said vertical wall, providing an outer wall on said upper portion that extends upwardly and outwardly from said vertical wall of the lower portion in a non-parallel orientation with respect to said vertical wall, providing an integral horizontal upper wall on said upper portion thereby defining said clamping surface, providing an integral rear wall on said upper portion that extends downwardly and inwardly to the front edge of the upper flange in a non-parallel orientation with respect to said vertical wall, providing a stainless steel wear plate, and providing said rear wall with a recessed portion for receiving a hook on a rear edge of the stainless steel wear plate and providing a front edge of said plate with a hook for engaging said recessed portion on the rear wall.

5. The method set forth in claim 4 including providing an integral web extending from the recessed portion to the rear surface of the front wall of said upper portion.

6. The method set forth in any one of claims 4 and 5 wherein said step of providing said front and rear walls comprises forming said front and rear walls such that they converge downwardly.

* * * * *